United States Patent [19]

McAllister et al.

[11] 4,152,237

[45] May 1, 1979

[54] DEFLECTED FLOW INLET SYSTEM FOR MERCURY CELLS

[75] Inventors: Haskell L. McAllister, Saraland, Ala.; Billy E. Scoggins, Cleveland, Tenn.

[73] Assignee: Olin Corporation, New Haven, Conn.

[21] Appl. No.: 937,299

[22] Filed: Aug. 28, 1978

[51] Int. Cl.[2] ..... C25B 1/36; C25B 9/00

[52] U.S. Cl. ..... 204/219; 204/220; 204/250

[58] Field of Search ..... 204/219, 220, 250, 99

[56] References Cited

U.S. PATENT DOCUMENTS

| | | | |
|---|---|---|---|
| 2,648,630 | 8/1953 | Basilewsky | 204/219 |
| 3,560,355 | 2/1971 | Shibata et al. | 204/219 X |
| 3,567,615 | 3/1971 | Nicolaisen | 204/219 |

FOREIGN PATENT DOCUMENTS

| | | | |
|---|---|---|---|
| 235756 | 4/1945 | Switzerland | 204/220 |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

A deflected flow inlet system for use in mercury-type electrolytic cells to help prevent inlet flow from jumping the inlet channel and splattering the mercury cathode onto the anodes.

13 Claims, 5 Drawing Figures

DEFLECTED FLOW INLET SYSTEM FOR MERCURY CELLS

This invention relates to mercury-type electrolytic cells and more specifically to improvements thereto.

Electrolytic cells are employed for the decomposition of solutions of alkali metal compounds using a mercury cathode which flows along the bottom of the cell and a plurality of anodes usually composed of a plate-like element supported from above by a stem, or stems. These plate-like elements have their bottom surfaces parallel to the surface of the mercury and spaced a short distance above it. An aqueous solution of alkali metal compound, commonly a halide, such as for example, sodium chloride, flows through the cell and immerses the anodes and parts of the stems. A thin layer of a solution thus occupies the space between the upper surface of the flowing mercury cathode and the bottom surface of the anode. DC current passes through the anodes, through the thin layer of solution and to the mercury cathode, liberating chlorine gas and forming sodium amalgam. Extreme care must be taken to prevent any direct contact between the anode and the cathode which would form a short circuit for the heavy current flowing through the cell. Typically, the anodes of such cells are dimensionally stable metal anodes such as those described in U.S. Pat. Nos. 3,912,616 and 3,953,316, commonly assigned. The space between the anode and cathode is conventionally adjusted by a mechanical device such as that disclosed in commonly assigned U.S. Pat. No. 3,390,070 and this mechanical device is preferably controlled by a computer system such as that disclosed in one or more of U.S. Pat. Nos. 3,844,913; 3,900,373; 3,873,430; 3,902,983; 3,983,025 and 4,004,989 all commonly assigned.

A problem has arisen in such mercury-type electrolytic cells in regard to premature burn-out of the anodes closest to the inlet through which the aqueous solution is supplied to the cell. Thus there is a need for diagnosis of that problem and the invention and design of a suitable solution to the problem, once diagnosed.

The apparatus of this invention is a result of the diagnosis by the inventor of this problem as being caused by the aqueous solution being introduced to the cell at such velocity that the aqueous solution splatters the flowing mercury cathode onto the anode surface thereabove causing the above-mentioned short circuiting. The invention provides an inlet system for the aqueous solution which substantially prevents such splattering. This is accomplished in the invention by the provision of a flowing mercury cathode cell for the electrolysis of aqueous solutions, said cell including an inclined trough having a cell bottom, sides and a cover, an inlet means and outlet means for said aqueous solution, inlet means for mercury and outlet means for mercury amalgam, chlorine outlet means, anodes supported within said trough and spaced above a mercury cathode flowing over said cell bottom and means for imposing an electric current on said anodes and cathodes, the improved inlet means for said aqueous solution which comprises:

(a) inlet channel means, attached to and lying transverse to said inclined trough, for introducing a uniform sheet-like flow of brine to a first inlet end of said trough, said inlet channel means having a bottom, a weir side with a surface facing inward toward said trough and over which weir side said sheet-like flow passes and an outer side higher than said weir side;

(b) flow spreader section means, vertically ascending into the bottom of said inlet channel means, for introducing said aqueous solution to said inclined trough through said channel means;

(c) an inlet conduit means, fluidly communicating with the lower end of said flow spreader means, for supplying said aqueous solution to said supply end of said flow spreader; and (d) flow baffle means, held between said upper surface of said outer side of said inlet channel means and said cover of said cell and projecting inwardly to a position behind an upper edge of said weir side, for preventing upward flow of said brine out of said vertically ascending flow spreader means into said channel means from flowing directly over said weir means and into said inclined trough at an excess flow rate by substantially blocking said flow and directing said upward flow laterally into said channel means so as to generate more uniform flow over said weir means into said inclined trough to thereby reduce splattering of mercury from said flowing cathode onto anodes of said cell.

The objects and advantages of the invention will be best understood by reference to the attached drawing, which is provided for illustrative purposes and which describes the best mode currently envisioned by the inventors for carrying out the purposes of the invention and in which.

Figure 1:
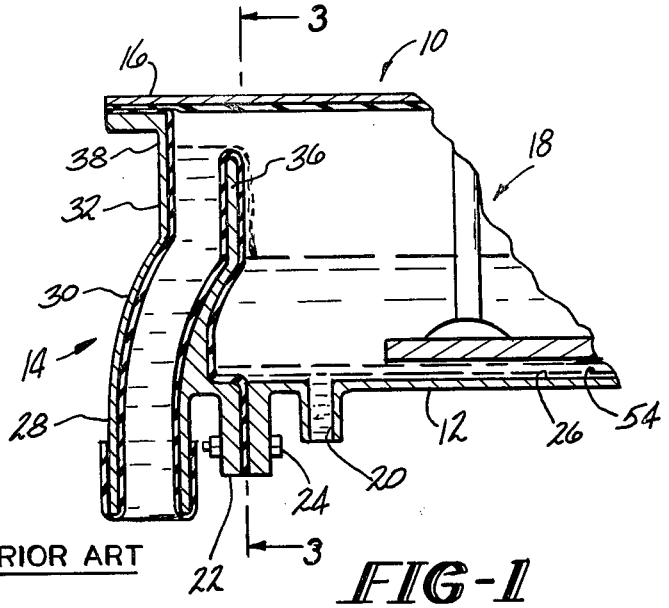
FIG. 1 is a lengthwise cross section of an upper end of a conventional prior art mercury cell.

FIG. 1 is a lengthwise cross section of the upper end of a conventional prior art mercury cell 10, such as for example that of U.S. Pat. No. 3,567,615 issued Mar. 2, 1971 to B. H. Nicolaisen. Mercury cell 10 is shaped like an inclined trough and comprises cell bottom 12, inlet end box 14, cell cover 16, a plurality of anodes 18 and a mercury inlet 20. End box 14 is attached to the upper end of cell bottom 12 by any suitable means such as flange 22 and bolt 24. Cell cover 16 lies atop and is supported by end box 14. Cell cover 16 preferably supports anodes 18 in a spaced parallel relationship to cell bottom 12. Mercury inlet 20 communicates with an upper surface 26 of cell bottom 12. Mercury is introduced through mercury inlet 20 to the interior of cell 10 and flows downwardly along upper surface 26 of cell bottom 12 from the upper end of cell 10 to a lower end (not shown) of cell 10. The lower end of cell 10 is preferably of design similar to that shown in FIG. 5 of U.S. Pat. No. 3,567,615 above-noted. An aqueous solution such as concentrated brine is introduced through end box 14 to the interior of cell 10 and also flows downwardly through cell 10 from the upper end shown in FIG. 1 to a corresponding lower end thereof. End box 14 comprises inlet conduit 28, a flow spreader 30 and a channel or trough 32. Aqueous solution is supplied from any conventional source of an appropriate aqueous solution to inlet conduit 28. The aqueous solution flows from conduit 28 through flow spreader 30 to inlet channel 32 and from inlet channel 32 into the upper end of cell 10. The inlet channel 32 has a bottom 34 (best seen in FIG. 5), a weir side 36 and an outer side 38 higher than the weir side 36 so that the aqueous solution flows along bottom 34 and over weir side 36 into cell 10.

Figure 4:
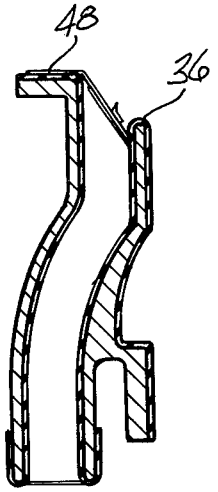
FIG. 4 is a vertical cross section taken along lines 4—4 of FIG. 3 showing the placement of the baffle means of FIG. 2.
Figure 5:
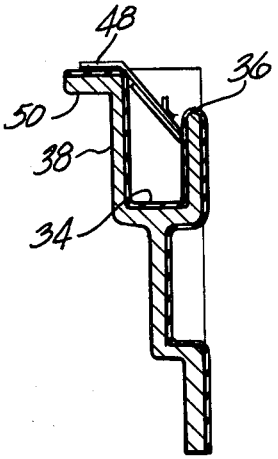
FIG. 5 is a vertical cross section taken along lines 5—5 of FIG. 3 showing the baffle means of FIG. 2 in place.
Figure 2:
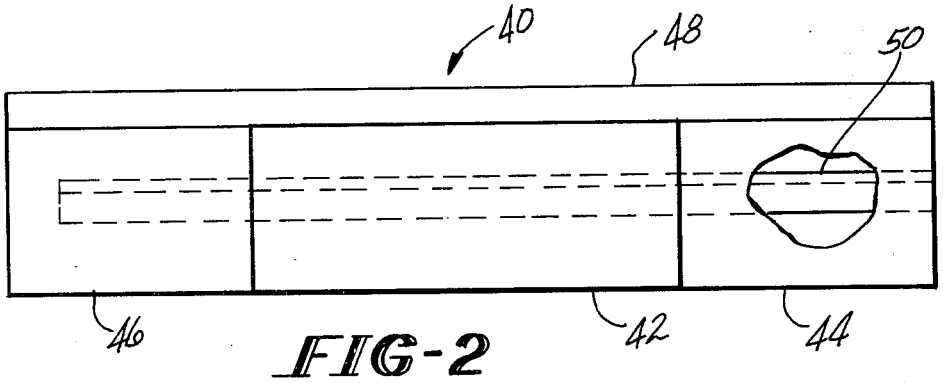
FIG. 2 is a rear view of a baffle means used in a preferred embodiment of the invention.

FIG. 2 shows a rear view of a baffle means 40 which, according to the invention, is utilized to substantially reduce direct flow of aqueous solution from flow spreader 30 over weir side 36 in order to minimize splattering of mercury which might otherwise be caused by such direct flow. Baffle means 40 includes central section 42, first edge section 44, second edge section 46 and top section 38. Baffle means 40 preferably also includes a reinforcing support 50 which is designed to give added stability and rigidity. Central section 42 is preferably a solid, plate-like sheet of corrosion-resistant and non-reactive material such as titanium, fiberglass or rubber. Any other corrosionresistant, non-reactive material may be used for central section 42. Edge sections 44 and 46 are preferably a mesh titanium screen, as is top section 48. However, a fiberglass screen or other non-corrosive and non-reactive perforate material may be utilized for edge sections 44 and 46 and top section 48. Reinforcing bar 50 can be of any rigid, non-corrosive, non-reactive material and can be of angular shape, as seen in FIGS. 2, 4 and 5 or can be of any other conventional shape which is capable of secure attachment to central section 42 or edge sections 44 and 46. Baffle means 40 is designed to fit into endbox 14 in the manner shown in FIGS. 3, 4 and 5 or in an equivalent manner such that flow must pass through baffle means 40 in order to pass from flow spreader 30 to cell 10.

Figure 3:
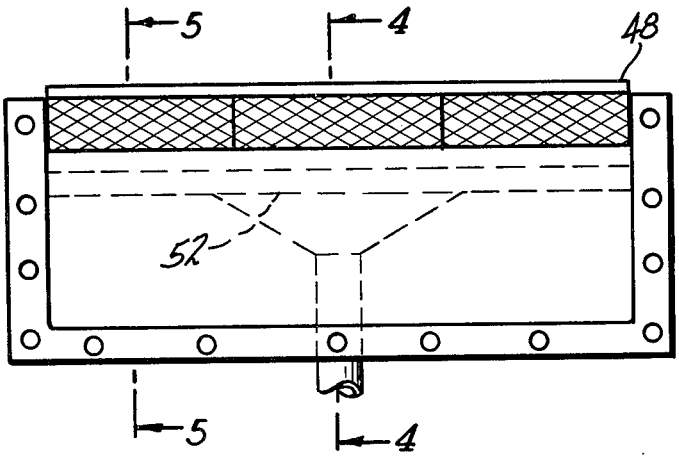
FIG. 3 is an inside or front view of a preferred embodiment of the invention with the baffle means of FIG. 2 in place.

As seen in FIGS. 3, 4 and 5, upper section 48 lies atop a flange 50 or outer side 38 in such a manner that the weight of cell cover 16, when placed on section 48, will hold baffle means 40 in place within inlet channel 32. Central section 42 and edge sections 44 and 46 are joined at an angle to top section 48 and project downwardly and diagonally across inlet channel 32 to weir side 36. Central section 42 is of sufficient width to extend completely over the outlet 52 of flow spreader 30 so that upward flow from flow spreader 30 will strike central section 42 and be deflected laterally rather than passing directly upward out of channel 32. After being deflected laterally by central section 42, aqueous solution may pass upwardly through edge sections 44 and 46 to fill the portion of channel 32 which lies above the diagonally positioned baffle means 40. From this position the aqueous solution uniformly flows over weir side 36 and into cell 10 without splattering the flowing mercury cathode 54 onto anodes 18.

The angle between upper section 48 and sections 42, 44 and 46 is preferably from about 100° to about 170°. The center section is preferably from about 1.2 to 2.0 times as wide as outlet 52. The baffle means may be entirely rigid or entirely flexible, although it is preferred that the baffle means 40 be rigid and for this purpose it is preferred to have reinforcing bar 50. However, baffle means 40 can alternatively have a rigid top and center section and flexible edge sections 44, 46 or can have a rigid center section 42 and a flexible top section 48 and flexible edge sections 44 and 46.

The operation of the deflected flow inlet system is self-evident from the above structural description and basically comprises laterally deflecting the upward flow of aqueous solution entering channel or trough 32 by dividing channel 32 into an upper and lower portion with a baffle therebetween. The upward flow of aqueous solution is laterally deflected by the baffle and therefore flows laterally through the lower portion of channel 32 and upwardly through edge sections 44 and 46 of the baffle means 40 and, in part, laterally back through the upper portion of channel 32 to the center section of channel 32. This laterally deflected flow results in more uniform flow of aqueous solution over weir side 36.

Many other embodiments within the scope of the invention will be readily apparent to those of ordinary skill in the art of mercury cell construction. For example, while the preferred baffle means completely and diagonally spans channel 32, the central section 42 could only partially span channel 32 so as to leave a slight gap between central section 42 and weir side 36 in order to allow partial direct upward flow of aqueous solution around central section 42. This partial upward flow could be utilized to allow more aqueous solution to flow into the center region of the upper portion of channel 32 if the lateral flow of aqueous solution in the upper portion of channel 32 is insufficient to provide enough aqueous solution to the center region thereof to generate uniform flow over weir side 36. Also, a solid top section 48 could be utilized in order to give improved sealing between top section 48 and cell cover 16. Other modifications will be similarly apparent.

What is claimed is:

1. In a flowing mercury cathode cell for the electrolysis of aqueous solutions, said cell including an inclined trough having a cell bottom, sides and a cover, an inlet means and outlet means for said aqueous solution, inlet means for mercury and outlet means for mercury amalgam, chlorine outlet means, anodes supported within said trough and spaced above a mercury cathode flowing over said cell bottom and means for imposing an electric current on said anodes and cathodes, the improved inlet means for said aqueous solution which comprises:

(a) inlet channel means, attached to and lying transverse to said inclined trough, for introducing a uniform sheet-like flow of brine to a first inlet end of said trough, said inlet channel means having a bottom, a weir side with a surface facing inward toward said trough and over which weir side said sheet-like flow passes and an outer side higher than said weir side;

(b) flow spreader section means, vertically ascending into the bottom of said inlet channel means, for introducing said aqueous solution to said inclined trough through said channel means;

(c) an inlet conduit means, fluidly communicating with the lower end of said flow spreader means, for supplying said aqueous solution to said supply end of said flow spreader; and (d) flow baffle means, held between said upper surface of said outer side of said inlet channel means and said cover of said cell and projecting inwardly to a position behind an upper edge of said weir side, for preventing upward flow of said brine out of said vertically ascending flow spreader means into said channel means from flowing directly over said weir means and into said inclined trough at an excess flow rate by substantially blocking said flow and directing said upward flow laterally into said channel means so as to generate more uniform flow over said weir means into said inclined trough to thereby reduce splattering of mercury from said flowing cathode onto anodes of said cell.

2. The improvement in inlet means of claim 1 wherein said flow baffle means comprises:

(a) a solid, flat center section longer than the width of said outlet end of said flow spreader means in the direction transverse to said trough and having an upper surface;

(b) a porous edge section attached to either side of said center section and coplanar therewith; and (c) a flat top section attached to said upper surface of said center section and lying at an angle to said center section, said top section being adapted to be held between said upper surface of said outer housing and said cover.

3. The improvement of claim 2, wherein:

(a) said flow spreader means and said inlet channel means are in fluid communication over a length less than the full length of said inlet channel means; and (b) said solid sheet-like center section is from 1.2 to 2.0 times as long as said length of said communication.

4. The improvement of claim 1 wherein the included angle between said center and top sections is from about 100° to about 170°.

5. The improvement of claim 2 wherein said top and center sections are rigid and said edged sections are flexible.

6. The improvement of claim 2 wherein said center section is rigid and said top and edge sections are flexible.

7. The improvement of claim 1 or 2 wherein said baffle means is entirely rigid.

8. The improvement of claim 1 wherein said baffle is flexible.

9. The improvement of claim 1 wherein said baffle means is comprised of a wet chlorine resistant metal 10. The improvement of claim 9 wherein said baffle means is comprised entirely of titanium.

11. The improvement of claim 1 wherein said baffle means is comprised entirely of a non-corrosive, non-reactive flexible material.

12. The improvement of claim 11, wherein said material is fiberglass.

13. The improvement of claim 11, wherein said material is rubber.

* * * * *